US005135672A

United States Patent [19]

Yabe et al.

[11] Patent Number: 5,135,672

[45] Date of Patent: Aug. 4, 1992

[54] ELECTROCONDUCTIVE MAGNETIC FLUID COMPOSITION AND PROCESS FOR PRODUCING THE SAME

[75] Inventors: Toshikazu Yabe, Fujisawa; Atsushi Yokouchi, Yokohama, both of Japan

[73] Assignee: Nippon Seiko Kabushiki Kaisha, Tokyo, Japan

[21] Appl. No.: 514,974

[22] Filed: Apr. 26, 1990

Related U.S. Application Data

[63] Continuation-in-part of Ser. No. 322,248, Mar. 10, 1989, abandoned.

[30] Foreign Application Priority Data

Nov. 3, 1988 [JP] Japan ..... 63-57830

[51] Int. Cl.[5] ..... H01F 1/28; H01B 1/06

[52] U.S. Cl. ..... 252/62.52; 252/74; 252/519

[58] Field of Search ..... 252/62.51, 62.52, 74, 252/507, 519, 520, 506

[56] References Cited

U.S. PATENT DOCUMENTS

| | | | |
|---|---|---|---|
| Re. 32,573 | 1/1988 | Furumura et al. | 252/62.52 |
| 4,315,827 | 2/1982 | Bottenberg et al. | 252/62.51 R |
| 4,356,098 | 10/1982 | Chagnon | 252/62.52 |
| 4,604,222 | 8/1986 | Bordoz et al. | 252/62.52 |
| 4,604,229 | 8/1986 | Raj et al. | 252/62.51 |
| 4,613,520 | 9/1986 | Dasgupta | 252/62.54 |
| 4,673,997 | 6/1987 | Gowda et al. | 252/62.52 |
| 4,867,910 | 9/1989 | Meguro et al. | 252/519 |

FOREIGN PATENT DOCUMENTS 263704 10/1988 Japan .

*Primary Examiner*—Gary P. Straub
*Assistant Examiner*—Stephen G. Kalinchak
*Attorney, Agent, or Firm*—Weintraub, DuRoss & Brady

[57] ABSTRACT

An electroconductive magnetic fluid composition is disclosed comprising a low volatility organic solvent as a carrier, a surface active agent having an lipophilic group with a strong affinity for the solvent, fine ferromagnetic particles coated at the surface thereof with the surface active agent and dispersed in the organic solvent, and a tertiary amine and an organic acid as an electrifying agent. The electroconductive magnetic fluid composition of the present invention is produced, preferably, including the steps of admixing fine ferromagnetic particles, a low boiling point organic solvent, an surface active agent and separating to remove any fine particles of poor dispersibility.

12 Claims, No Drawings

ELECTROCONDUCTIVE MAGNETIC FLUID COMPOSITION AND PROCESS FOR PRODUCING THE SAME

CROSS-REFERENCE TO RELATED APPLICATION

The present application is a continuation-in-part of U.S. patent application Ser. No. 322,248, filed Mar. 10, 1989, now abandoned the disclosure of which is hereby incorporated by reference.

BACKGROUND OF THE INVENTION

1. Field of the Invention

The present invention concerns an electroconductive magnetic fluid composition provided with antistatic properties, and a process for producing the same.

2. Description of the Prior Art

Since magnetic fluids generally exhibit high electrical resistance, when they are used, for example, as the sealing mechanism for magnetic disc devices, etc., it has been the general practice to incorporate electrical grounding means into such devices for eliminating static charges accumulated on the magnetic disc devices, etc. (hereinafter simply referred to as electrified body). In view of the above, electroconductive magnetic fluids have been proposed in the prior art which are capable of preventing static charges without the use of such grounding means, by providing electroconductivity to the magnetic fluid per se (refer to U.S. Pat. No. 4,604,222 and Japanese Patent Laid-Open No. Sho 610274737).

An organic solvent such as mineral oil or poly-alpha-olefin oil is used as a carrier in some of the prior art, and an anionic surface active agent is used for stably dispersing fine ferromagnetic particles in the carrier in the usual magnetic fluids. A cationic surface active agent, for example, a quarternary ammonium salt represented by the structural formula:

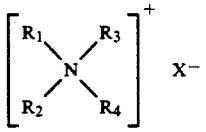

where X represents a halogen and $R_1$–$R_4$ each represent a hydrocarbon chain, is used in the prior art for forming a coating layer or a second coating layer on fine ferromagnetic particles.

The prior art cationic surface active agent comprises a polar cationically charged portion, and a long-chained nonpolar portion which is mutually soluble in the carrier. The surface of the fine ferromagnetic particles is coated with the surfactant, the positively charged portion of the surfactant being electrostatically absorbed to the particle surface, and the long-chained portion of the surfactant being directed toward the surrounding carrier. The magnetic particles are thereby stably dispersed in the carrier and the electroconductivity of the magnetic fluid is improved. Accordingly, it is possible to use this prior art electroconductive magnetic fluid, for example, as a sealing agent for a disc driving device, so that static charges, which would otherwise tend to be accumulated on the disc, can be removed to attain antistatic performance.

However, the conventional electroconductive magnetic fluids as described above have the following problems:

(1) Since each of the magnetic particles are coated with the cationic surface active agent as a charged body, the magnetic particles tend to be moved under the effect of the charge possessed by the electrified body towards that opposite charge. This tends to make the distribution of the particle concentration not uniform in the magnetic fluid. Accordingly, when the electroconductive magnetic fluid is used, for example, as a sealing agent, the saturation magnetization thereof is reduced where the concentration of the magnetic particles is low, which may even lead to the destruction of the sealing oil membranes and resultant deterioration of the sealing performance.

(2) When the electric charges on the electrified body are offset with the cationic surface active agent, the cationic surface active agent tends to be easily detached from the surface of the fine ferromagnetic particles and, accordingly, satisfactory dispersion of the fine ferromagnetic particles is harder to achieve in the magnetic fluid.

(3) The cationic surface active agent serves both for dispersing the ferromagnetic particles and providing electroconductivity to the fluid. Accordingly, the amount of the surfactant added is inevitably limited by the concentration of the fine ferromagnetic particles and, thus, the quantity of the saturation magnetization, making it difficult to independently control the electroconductivity of the solution.

(4) Since a cationic surface active agent of poor heat resistance is used in the prior art, the surface active agent is decomposed or evaporated at high temperature with elapse of time. Accordingly, the electroconductivity of the magnetic fluid conditioned by adding the surface active agent is gradually lowered as the surfactant is lost.

The antistatic agent generally utilized so far for synthetic fibers or synthetic resins includes quarternary ammonium salts i.e., cationic surface active agents, as well a tertiary amines as nonionic surface active agents, e.g., N. N-bis(2-hydroxyethyl)aliphatic amine:

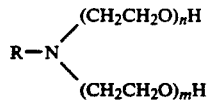

where m, n each represents an integer of 1 or greater and R represents an aliphatic hydrocarbon chain. However, prior art compounds generally have poor heat resistance and tend to decompose at a high temperatures with elapse of time, and this tends to result in a reduction of the antistatic properties of the fluid.

SUMMARY OF THE INVENTION

The present invention has been developed in view of the foregoing problems in the prior art, and an object thereof is to provide an electroconductive magnetic fluid composition showing substantially homogeneous dispersion of fine ferromagnetic particles under the effect of electric charges of electrified bodies, free from detachment of a surface active agent from the surface of the fine ferromagnetic particles. The ferrofluid of the present invention is capable of optionally controlling the electroconductivity, and is stable even during use under high temperature.

Another object of the present invention is to provide a process for producing such an electroconductive magnetic fluid composition as described above.

The object of the present invention can be attained by an electroconductive magnetic fluid composition comprising an organic solvent of low volatility as a carrier, a surface active agent having a lipophilic group which is mutually soluble in the organic solvent, fine ferromagnetic particles dispersed in the organic solvent, and an agent for providing electroconductivity, comprising a tertiary amine and an organic acid.

As the organic acid, a fatty acid is especially effective.

The fatty acids useful in the practice of the present invention have the general formula:

$$RCOOH$$

in which R represents a linear hydrocarbon chain with not less than 12 carbon atoms or a hydrocarbon chain having at least one branched chain with not less than 12 carbon atoms.

Another object of the present invention can be attained by a process for producing an electroconductive magnetic fluid composition comprising the steps of:

(a) adding fine ferromagnetic particles to a low boiling point organic solvent and a surface active agent having a lipophilic group which is mutually soluble therein for coating the surface of the fine ferromagnetic particles, thereby obtaining an intermediate medium in which the fine ferromagnetic particles are coated at the surface thereof with the surface active agent and are uniformly dispersed in the low boiling point organic solvent;

(b) separating out any fine particles of poor dispersibility in the intermediate medium and, thereafter, adding a less volatile organic solvent to the intermediate medium to form a mixture;

(c) heating the mixture to evaporate and separate the low boiling point organic solvent to obtain a magnetic fluid; and (d) adding a mixture comprising a tertiary amine and a fatty acid to provide electroconductivity to the resultant magnetic fluid.

As used herein, the term "mutually soluble" is intended to mean the surfactant is substantially or completely miscible in the carrier fluid, as well as soluble in the low boiling point solvent.

An alternative process for producing an electroconductive magnetic fluid composition according to the present invention comprises the steps of:

(a) adding a low boiling point organic solvent and a surface active agent having a lipophilic group which is mutually soluble therein to fine ferromagnetic particles to bond the surface active agent to the surface of the fine ferromagnetic particles;

(b) thereafter, removing the low boiling point organic solvent to obtain fine ferromagnetic particles coated at the surface thereof with the surface active agent;

(c) mixing the fine ferromagnetic particles with a low volatility organic solvent and a mixture comprising a tertiary amine and a fatty acid; and (d) removing any fine particles of poor dispersibility from the mixture.

DETAILED DESCRIPTION OF THE PREFERRED EMBODIMENTS

In the electroconductive magnetic fluid according to the present invention, a surface active agent having a nonpolar lipophilic group and a polar end disperses fine ferroelectric particles uniformly in a carrier comprising a low volatility organic solvent. Further, a separately added mixture comprising a tertiary amine and a fatty acid improves the electroconductivity of the magnetic fluid to provide an antistatic property thereto wherein the substance improving the electroconductivity is different from the surface active agent and the surface active agent prevents the electroconductivity providing substance from being absorbed to the surface of the ferromagnetic particles.

Since the mixture as the agent for providing electroconductivity (hereinafter referred to as an electrifying agent) is a mixture of a tertiary amine of higher heat resistivity as compared with the conventional antistatic agent and a fatty acid also having higher heat resistivity, there is no aging reduction of electroconductivity with the fluid of the present invention, even at a high temperature.

In a state where the mixture of the tertiary amine and fatty acid is dissolved in the carrier, it is expected that such a reaction mechanism as is shown below for the proton transition state takes place, as an acid-base reaction between the tertiary amine and the fatty acid, by which the conductivity is caused in the carrier per se. Accordingly, use of the acid and the amine at 1:1 molar ratio is preferred. While not wishing to be bound by any theory, it is believed that the tertiary amine and fatty acid do not form a salt, per se, but rather form a complex through hydrogen bonding of the $H^+$ ion in transitional state, as shown:

$$RCOO^- \ldots H^+ \ldots \begin{array}{c} R' \\ | \\ N-R' \\ | \\ R' \end{array}$$

In the electroconductive magnetic fluid according to the present invention, the electrifying agent improves the electroconductivity of the carrier. Accordingly, in contrast with the conventional case where the electrifying agent having the surface active effect is used both for dispersing and providing electroconductivity to the magnetic particles, there is no undesired effect of the electric charges of an electrified body to the dispersion of fine ferromagnetic particles in the present invention.

Furthermore, since the amount of the electrifying agent to be added can be controlled irrespective of the concentration of the magnetic particles, it is possible to control the electroconductivity of the electroconductive magnetic fluid independently of the amount of surfactant required.

Referring to the carrier as the dispersing medium for fine ferromagnetic particles in the present invention, there can be properly used those low volatility organic solvents such as various hydrocarbons including mineral oils, synthetic oils and ethers or esters, or silicone oils depending on the application uses of the magnetic fluid. Poly-alpha-olefin oils, alkyl naphthalene oils, octadecyldiphenyl ether oil, etc. are preferred as a sealing agent for use in magnetic discs. The carrier fluids of the present invention preferably have a vapor pressure in the range from $1\times10^{-10}$ to $1\times10^{-3}$ torr at 25° C.

As to the fine ferromagnetic particles for use in the present invention, magnetite colloids obtained by a well-known so-called wet grinding process, i.e., by grinding magnetite particles in water or organic solvent in a ball mill may also be used.

In the case of using the wet grinding process, if an organic solvent, for example, hexane is used as a grinding liquid, a ferromagnetic powder and a surface active agent in such an amount as is capable of forming a monomolecular layer on the particle surface thereof may be added and then ground in a ball mill for several hours or more.

In addition to magnetite, ferromagnetic oxides such as manganese ferrite, cobalt ferrite or composite ferrite comprising also zinc or nickel, barium ferrite, etc. or ferromagnetic metals such as iron, cobalt and rare earth elements may also be used.

Furthermore, fine ferromagnetic particles obtained by a dry process can also be used in addition to those obtained by the wet process or wet grinding process.

The content of the fine ferromagnetic particles in the fluid of the present invention may be within a range from 1 to 20% by volume ratio as used generally so far, or may be such an extremely high concentration as about 70% if required. That is, according to the present invention, the concentration of the fine ferromagnetic particles can be controlled to a level reaching as high as 70% by utilizing an intermediate medium in which fine ferromagnetic particles are dispersed in a low boiling point solvent as described later. This can provide a magnetic fluid of extremely high magnetization.

As the dispersant for the fine ferromagnetic particles used in the present invention, those having greater affinity for the low volatility organic solvent are preferred. They can properly be selected for use from anionic surface active agents such as oleic acid or a salt thereof, petroleum sulfonic acid or a salt thereof and synthetic sulfonic acid or a salt thereof, which are hydrocarbon compounds having polar groups such as carboxyl group, hydroxyl group and sulfonic group. Nonionic surface active agents such as polyoxyethylene nonylphenyl ether; or amphoteric surface active agents, for example, alkyldiaminoethyl glycine having both a cationic moiety and an anionic moiety in the molecular structure, are also suitable for use in the ferrofluid of the present invention.

The agent for providing electroconductivity should be present in the ferrofluid of the present invention in an amount not exceeding 25% by weight of the total weight of the ferrofluid.

The combination of a tertiary amine and a fatty acid as the electrifying substance for use in the present invention may comprise, for example, tri-n-octyl amine:

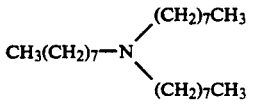

and isostearic acid:

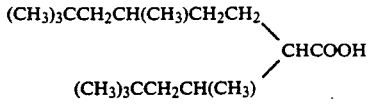

which are mixed in a 1:1 molar ratio.

The tertiary amines usable herein, may be those having three linear chains, each of an identical chain length, such as tri-n-octylamine as described above and those having three skeleton chains each branched and of identical chain length, for example, tri-isoamyl amine of the formula:

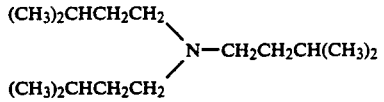

Furthermore, they may be those having three chains, two of which are of identical length or those having three chains all of which are of different length.

Furthermore, those containing one or more benzene rings, for example, N,N-diethyl-n-toluidine

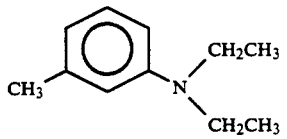

may also be used.

In any of the cases, the tertiary amine usable in the present invention has only nonpolar, lipophilic groups thereon and, in this regard, it is different from the conventional tertiary amines used as the surface active agent having both the lipophilic group and the hydrophilic group as described above. Use of such material can contribute to the improvement of the electroconductivity and the heat resistivity of the fluid with no hindrance to the dispersion of the fine ferromagnetic particles.

The fatty acid used in conjunction with the tertiary amine may be a long-chained fatty acid having at least one branch, such as isostearic acid, or a linear long-chained fatty acid. Among them, a branched fatty acid is preferred for the reasons described below.

It is considered that a linear chained fatty acid can easily intrude between the hydrophobic chains in the mono-molecular layer of the surface active agent at the surface of the fine ferromagnetic particles, because of the smaller molecular diameter thereof, whereas such intrusion is difficult in the case where the acid has side chains since the molecular diameter thereof is large.

Specifically, in the case of the linear-chain structure, it tends to easily form two-phase adsorption to give an undesired effect on the dispersion of the particles, in the second absorption of which the hydrophilic group is directed to the carrier. On the other hand, in the case where the side chains are present, they show a remarkable trend of improving only the electroconductivity without deteriorating the dispersion of the ferromagnetic particles.

As the fatty acid, mono-carboxylic acid having one carboxylic group and or poly-carboxylic acid are definitely applicable. Here is different mol-ratio between the fatty acid and tertiary amine depending on numbers of the carboxylic group.

That is, in case of mono-carboxylic acid, fatty acid:tertiary amine = 1:1, in case of di-carboxylic acid, fatty acid:tertiary amine = 1:2, and in case of tri-carboxylic acid or poly-carboxylic acid moreover therefrom, fatty acid:tertiary amine ≧ 1:2.

In the process for producing the magnetic fluid composition according to the present invention, if it is desired to efficiently remove particles of poor dispersibility in the fine ferromagnetic particles to obtain a magnetic fluid of high stability, or if it is desired to increase the concentration of the fine ferromagnetic particles to be dispersed in the carrier, to obtain a magnetic fluid having high magnetization performance, use of the production process for the magnetic fluid proposed previously by the present applicant is effective (Japanese Laid-Open Patent No. Sho 58-174495).

In the practice of this production process, fine ferromagnetic particles and a surface active agent are at first added to a low boiling point organic solvent, such as tolvene, hexane, or benzene, as well as mixtures thereof, to thereby obtain an intermediate medium in which the fine ferromagnetic particles, coated at the surface thereof with the surface active agent, are dispersed in the low boiling point organic solvent. The solvent used should have a boiling point at or below 120° C. In the case of using fine ferromagnetic particles obtained from the wet process, the intermediate medium may be prepared by adding a required amount of the surface active agent to an aqueous suspension of fine ferromagnetic particles to form a coating layer thereon, once washing and then drying them to obtain fine hydrophobic ferromagnetic particles, and, thereafter, adding a low boiling point organic solvent.

Then, fine particles of poor dispersibility in the intermediate medium are removed by centrifugation at from 5000 to 8000 G. Since the viscosity of the intermediate medium comprising the low boiling point organic solvent is extremely low, the centrifugal separation can be performed efficiently.

Subsequently, a less volatile organic solvent, as the carrier fluid, and a mixture of the tertiary amine and fatty acid in 1:1 molar ratio are admixed, and the mixture is heated in an atmospheric or reduced pressure environment to remove the low boiling point organic solvent by distillation, or the intermediate medium is heated to evaporate the low boiling point organic solvent, to thereby form an extremely stable solution of an electroconductive magnetic fluid.

In this case, it is also possible to repeat the procedure of adding the intermediate medium followed by applying heat as required to the thus resultant magnetic fluid composition, thereby obtaining a magnetic fluid in which fine ferromagnetic particles are stably dispersed at extremely high concentration.

It is not always necessary that the process for producing the magnetic fluid composition according to the present invention be conducted by way of the intermediate medium. In the alternative case, fine ferromagnetic particles, a low boiling point organic solvent, and a surface active agent are mixed to coat the surface of the particles with the surface active agent. Directly thereafter, the low boiling point organic solvent is removed by heating. Subsequently, a less volatile organic solvent as the carrier fluid, and an equimolar mixture of a tertiary amine and a fatty acid are added to provide electroconductivity to the composition. The ferrofluid mixture is then subjected to centrifugal separation to remove any fine ferromagnetic particles of poor dispersibility.

The above-mentioned steps may be selected depending on the kind, purpose of use, required performance, etc. for the products.

Furthermore, the mixture comprising the tertiary amine and the fatty acid 1:1 molar ratio may be finally added to the magnetic fluid formed by using the organic solvent as the carrier.

The electroconductive magnetic fluid composition according to the present invention can provide the following advantageous effects:

The surface active agent contributes to the dispersion of the fine ferromagnetic particles in the carrier, while the mixture of the tertiary amine and the organic acid, with no surface active effect, serves to provide the carrier with electroconductivity. Accordingly, upon eliminating static charges from an electrified body, an undesired phenomenon, i.e., the fine ferromagnetic particles being moved together by the electrified body with the surfactant serving both for providing the electroconductivity and dispersing effect, is not caused in the present invention. As a result, dispersion of the fine ferromagnetic particles can always be kept uniform to maintain a high sealing performance. In addition, since the surface active agent does not detach from the fine ferromagnetic particles, the working life of the magnetic fluid can be improved.

Further, since the amount of the electrifying substance to be added is not restricted by the concentration of the fine ferromagnetic particles, the electroconductivity can be controlled independently of such concentration of ferromagnetic particles.

Further, in a preferred embodiment in which a branched fatty acid is used as one of the constituents for the electrifying agent, formation of the two phase adsorption encountered with the prior art can be prevented to improve the electroconductivity, with no hindrance to the dispersion of the fine ferromagnetic particles.

Furthermore, since the electrifying substance comprises highly heat resistant components, high electroconductivity can be maintained even during use at high temperature.

In the process for producing the electroconductive magnetic fluid, according to the present invention, described above, fine ferromagnetic particles of excellent dispersibility can be dispersed uniformly at high concentration in the carrier, and an electroconductive magnetic fluid having a stable electroconductivity can be easily produced.

EXAMPLES

Description is to be made hereinafter referring to specific examples of embodiments of the electroconductive magnetic fluid composition according to the present invention. These examples are intended to be illustrative, rather than limitative.

EXAMPLE 1

At first, an aqueous 6N solution of NaOH was added to one liter of an aqueous solution containing 0.3 mol each of ferrous sulfate and ferric sulfate until the pH value of the solution was increased to higher than 11. Then the solution was aged at 60° C. for 30 minutes, to obtain an aqueous slurry of a magnetic colloid. Then, it was washed with water at room temperature to remove electrolytes in the slurry. This is a step for producing a magnetite colloid by the wet process.

After adding an aqueous 3N solution of HCl to the thus obtained magnetite colloid solution to adjust the pH level to 3, 30 g of synthetic sodium sulfonate was added as a surface active agent. The mixture was then stirred at 60° C. for 30 minutes to absorb the surface active agent to the surface of the magnetite particles. Then, the mixture was allowed to stand to allow the magnetite particles to coagulate and settle, and then the supernatant liquid was discarded. After further stirring with addition of water, the solution was once again allowed to stand still, and then the supernatant liquid was again discarded. After repeating the water washing several times to remove the electrolytes from the aqueous solution, it was filtered, dehydrated and dried to obtain fine powdery magnetite particles coated at the surface thereof with the surface active agent.

Then, hexane was added as a low boiling point solvent to the magnetite powder and the mixture was shaken sufficiently to obtain an intermediate medium in which magnetite particles were dispersed in hexane. The intermediate medium was then subjected to a centrifugal separator and centrifugally separated under 8000 G for 30 minutes, by which, relatively large particles of poor dispersibility were removed by centrifugal precipitation. Then, the remaining supernatant liquid, in which non-precipitated fine magnetite particles were dispersed, was transferred to a rotary evaporator and the low boiling point solvent ingredient, that is, hexane, was removed by evaporation while the mixture was maintained at 90° C. to obtain fine lipophilic magnetite particles.

5 g of the fine magnetic particles were collected and, after dispersing them again in hexane, 4 g of octadecyl diphenyl ether as the carrier was admixed. The mixed solution was transferred to a rotary evaporator and the low boiling point solvent ingredient, that is, hexane, was removed by evaporation while the mixture was maintained at 90° . As a result, the magnetite was dispersed in the carrier. The dispersion was further subjected to the centrifugal separator and processed for 30 minutes under the centrifugal force of 8000 G. Non-dispersed solid matters were removed by these procedures to obtain an extremely stable magnetic fluid.

Then, after adding 0.9 g of a mixture of isostearic acid and tri-n-octyl amine in 1:1 molar ratio to 3.0 g of the magnetic fluid containing the octadecyl diphenyl ether as the carrier, hexane was further added to dissolve the solute uniformly. The mixed solution was transferred to a rotary evaporator and the low boiling point solvent ingredient, that is, hexane, was removed by evaporation while the mixture was maintained at 90° C. As a result, the magnetite and the mixture of isostearic acid and tri-n-octyl amine in 1:1 molar ratio were dispersed in the carrier, to obtain an extremely stable magnetic fluid.

When the magnetic fluid was formed as an annular magnetic fluid seal of 7 mm inner diameter, 7.4 mm outer diameter and 0.7 mm thickness and the electric resistance value was measured between the inner and the outer circumferential surfaces, it was 2.70M ohm. When the value was converted as the volumic resistance value by using the following equation: $R=3.85\ r$ in which R represents the volumic resistance value (ohm.cm) and r represents the electric resistance value measured as above, R=10.40M ohm.cm and sufficient antistatic function was recognized.

EXAMPLE 2

In a similar procedure to that outlined in Example 1, a magnetic fluid was prepared using octadecyl diphenyl ether as a carrier.

Then, after adding 0.9 g of a mixture of isostearic acid and tri-n-hexyl amine in a 1:1 molar ratio to 3.0 g of the magnetic fluid, hexane was further added to dissolve the solute uniformly. The liquid mixture was transferred to a rotary evaporator and the low boiling point solvent ingredient, that is, hexane, was removed by evaporation while the mixture was maintained at 90° C. As a result the magnetite, and a mixture of isostearic acid and tri-n-hexyl amine in 1:1 molar ratio were dispersed in the carrier, to obtain an extremely stable magnetic fluid.

Further, when the electric resistance value for the magnetic fluid was measured in the same manner as above, r=2.40M ohm and the volumic resistance value R converted therefrom was 9.24M ohm.cm, and sufficient antistatic function was recognized.

EXAMPLE 3

In a similar procedure to that outlined in Example 1, a magnetic fluid was prepared by using octadecyl diphenyl ether as a carrier.

Then, after adding 0.9 g of a mixture of isostearic acid and tri-isoamyl amine in 1:1 molar ratio to 3.0 g of the magnetic fluid, hexane was further added to dissolve the solute uniformly. The liquid mixture was transferred to a rotary evaporator and the low boiling point solvent ingredient, that is, hexane, was removed by evaporation while the mixture was maintained at 90° C. As a result, the magnetite, and a mixture of isostearic acid and tri-isoamyl amine in 1:1 molar ratio were dispersed in the carrier, to obtain an extremely stable magnetic fluid.

Further, when the electric resistance value for the magnetic fluid was measured in the same manner as above, r=3.00M ohm and the volumic resistance value R converted therefrom was 11.55M ohm.cm, and sufficient antistatic function was recognized.

EXAMPLE 4

In a similar procedure to that outlined in Example 1, a magnetic fluid was prepared by using octadecyl diphenyl ether as a carrier.

Then, after adding 0.9 g of a mixture of isostearic acid and N,N-diethyl-m-toluidine in 1:1 molar ratio to 3.0 g of the magnetic fluid, hexane was further added to dissolve the solution uniformly. The liquid mixture was transferred to a rotary evaporator and the low boiling point solvent ingredient, that is, hexane, was removed by evaporation while the mixture was maintained at 90° C. As a result, the magnetite, and a mixture of isostearic acid and N,N-diethyl-m-toluidine in 1:1 molar ratio were dispersed in the carrier, to obtain an extremely stable magnetic fluid.

Further, then the electric resistance value for the magnetic fluid was measured in the same manner as above, r=9.70M ohm and the volumic resistance value R converted therefrom was 37.35M ohm.cm, and sufficient antistatic function was recognized.

EXAMPLE 5

In a similar procedure to that outlined in Example 1, a magnetic fluid was prepared by using octadecyl diphenyl ether as a carrier.

Then, after adding 0.9 g of a mixture of isostearic acid and tri-n-butyl amine in 1:1 molar ratio to 3.0 g of the magnetic fluid, hexane was further added to dissolve the solute uniformly. The liquid mixture was transferred to a rotary evaporator and the low boiling point solvent ingredient, that is hexane, was removed by evaporation while the mixture was maintained at 90° C. As a result, the magnetite, and a mixture of isostearic acid and tri-n-butyl amine in 1:1 molar ratio were dispersed in the carrier, to obtain an extremely stable magnetic fluid.

Further, when the electric resistance value for the magnetic fluid was measured in the same manner as above, r=2.50M ohm and the volumic resistance value R converted therefrom was 9.63M ohm.cm, and sufficient antistatic function was recognized.

EXAMPLE 6

In a similar procedure to that outlined in Example 1, a magnetic fluid was prepared by using octadecyl diphenyl ether as a carrier.

Then, after adding 0.9 g of a mixture of isostearic acid and tri-n-pentyl amine in 1:1 molar ratio to 3.0 g of the magnetic fluid, hexane was further added to dissolve the solute uniformly. The liquid mixture was transferred to a rotary evaporator and the low boiling solvent ingredient, that is, hexane was removed by evaporation while being maintained at 90° C. As a result, the magnetite, and a mixture of isostearic acid and tri-n-pentyl amine in 1:1 molar ratio were dispersed in the carrier, to obtain an extremely stable magnetic fluid.

Further, when the electric resistance value for the magnetic fluid was measured in the same manner as above, r—2.50M ohm and the volumic resistance value R converted therefrom was 9.63M ohm.cm, and sufficient antistatic function was recognized.

EXAMPLE 7

In the same procedures as those in Example 1, a magnetic fluid was prepared using octadecyl diphenyl ether as a carrier.

Then, after adding 0.9 g of a mixture of isostearic acid and triethyl amine in 1:1 molar ratio to 3.0 g of the magnetic fluid, hexane was further added to dissolve uniformly.

The mixture was transferred to a rotary evaporator and the low boiling point solvent ingredient, that is, hexane, was removed by evaporation while the mixture was maintained at 90° C. As a result, the magnetite, and a mixture of isostearic acid and triethyl amine in 1:1 molar ratio were dispersed in the carrier, to obtain an extremely stable magnetic fluid.

Further, when the electric resistance value for the magnetic fluid was measured in the same manner as above, r=5.80M ohm and the volumic resistance value R converted therefrom was 22.33M ohm.cm, and sufficient antistatic function was recognized.

EXAMPLE 8

In a similar procedure to that outlined in Example 1, a magnetic fluid was prepared by using octadecyl diphenyl ether as a carrier.

Then, after adding 0.9 g. of a mixture of isostearic acid and tri-n-octyl amine in 1:1 molar ratio to 3.0 g of the magnetic fluid, hexane was further added to dissolve the solute uniformly. The liquid mixture was transferred to a rotary evaporator and the low boiling point solvent ingredient, that is, hexane, was removed by evaporation while the mixture was maintained at 90° C. As a result, the magnetite, and a mixture of isostearic acid and tri-n-octyl amine in 1:1 molar ratio were dispersed in the carrier, to obtain an extremely stable magnetic fluid.

Further, when the electric resistance value for the magnetic fluid was measured in the same manner as outlined above, r=3.00M ohm and the volumic resistance value R converted therefrom was 11.55M ohm.cm, and sufficient antistatic function was recognized.

The following table, Table 1, shows the structures of tertiary amines and aliphatic acids used in each of Examples 1-8 above and magnetic resistance values r for the magnetic fluids prepared by adding them.

TABLE 1

| Example No. | Tertiary amine | Fatty acid | Electric resistance value (MΩ) |
|---|---|---|---|
| 1 | $(CH_3(CH_2)_7)_3N$ | $(CH_3)_3CCH_2CH(CH_3)CH_2CH_2CHCOOH(CH_3)_3CCH_2CH-CH_3$ | 2.70 |
| | Tri-n-octyl amine | Isostearic acid | |
| 2 | $(CH_3(CH_2)_5)_3N$ | " | 2.40 |
| | Tri-n-hexyl amine | | |
| 3 | $((CH_3)_2CH(CH_2)_2)_3N$ | " | 3.00 |
| | Tri-isoamyl amine | | |

TABLE 1-continued

| Example No. | Tertiary amine | Fatty acid | Electric resistance value (MΩ) |
|---|---|---|---|
| 4 | 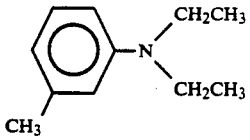 N,N-diethyl-m-toluidine | " | 9.70 |
| 5 | $CH_3(CH_2)_3$ $N-(CH_2)_3CH_3$ $CH_3(CH_2)_3$ Tri-n-butyl amine | " | 2.50 |
| 6 | $CH_3(CH_2)_4$ $N-(CH_2)_4CH_3$ $CH_3(CH_2)_4$ Tri-n-pentyl amine | " | 2.50 |
| 7 | $CH_3CH_2$ $N-CH_2CH_3$ $CH_3CH_2$ Tri-ethyl amine | " | 5.80 |
| 8 | $CH_3(CH_2)_7$ $N-(CH_2)_7CH_3$ $CH_3(CH_2)_7$ Tri-n-octyl amine | $CH_3(CH_2)_8CHCOOH$ $(CH_2)_6CH_3$ Isostearic acid | 3.00 |

Having, thus, described the invention, what is claimed is:

1. An electroconductive magnetic fluid composition consisting essentially of:
   (a) an organic solvent as a carrier;
   (b) a surface active agent having a lipophilic group which is soluble in said organic solvent;
   (c) ferromagnetic particles coated at the surface thereof with said surface active agent and dispersed in said organic solvent; and
   (d) a substance for providing electroconductivity, consisting essentially of a complex of a tertiary amine and a fatty acid, the electroconductivity providing substance being different from the surface active agent;

wherein said fatty acid has a linear or branched hydrocarbon chain with 12 or more carbon atoms.

2. The electroconductive magnetic fluid composition claimed in claim 1, wherein said fatty acid is a monocarboxylic acid.

3. The electroconductive magnetic fluid composition claimed in claim 1, wherein said fatty acid is a poly-carboxylic acid.

4. The electroconductive magnetic fluid composition claimed in claim 1, wherein the tertiary amine and fatty acid are present in an equimolar ratio.

5. The electroconductive magnetic fluid composition claimed in claim 1, wherein said surface active agent is selected from the group consisting of:
   anionic surfactants, nonionic surfactants, amphoteric surfactants, and mixtures thereof.

6. The electroconductive magnetic fluid composition claimed in claim 1, wherein said organic solvent is selected from the group consisting of:
   mineral oil, synthetic oil, ethers, esters, and mixtures thereof.

7. The electroconductive magnetic fluid composition claimed in claim 1, wherein said tertiary amine consisting of:
   a nitrogen, three chains combined with said nitrogen, each of said chains selected from the group consisting of aliphatic hydrocarbons being linear or branched, and aromatic hydrocarbons.

8. The electroconductive magnetic fluid composition claimed in claim 1, wherein said complex of tertiary amine and fatty acid added is present in no more than 25% by weight of the total weight of the composition.

9. The electroconductive magnetic fluid composition claimed in claim 7, wherein said tertiary amine is selected from the group consisting of:
   tri-n-octyl amine, tri-n-hexyl amine, tri-isoamyl amine, N,N-diethyl-m-toluidine, tri-n-butyl amine, tri-n-pentyl amine, tri-ethyl amine, and mixtures thereof.

10. The electroconductive magnetic fluid composition claimed in claim 2, wherein said fatty acid is isostearic acid.

11. An electroconductive magnetic fluid composition comprising:
   (a) an organic solvent as a carrier;
   (b) ferromagnetic particles dispersed in said organic solvent;
   (c) a substance for providing electroconductivity, consisting essentially of a complex of a tertiary amine and a fatty acid, said electroconductivity providing substance being dissolved only in said organic solvent;

(d) a surface active agent being absorbed to and coating the surface of said ferromagnetic particles, thereby to disperse said ferromagnetic particles in said organic solvent;

said surface active agent preventing said electroconductivity providing substance from being absorbed to the surface of said ferromagnetic particles, thereby to render said electroconductivity providing substance dissolved only in said organic solvent;

wherein said fatty acid has a linear or branched hydrocarbon chain with 12 or more carbon atoms.

12. The electroconductive magnetic fluid composition claimed in claim 11, wherein said organic solvent is selected from the group consisting of:

mineral oils, synthetic oils, ethers, esters, and mixtures thereof.

* * * * *